US006198806B1

(12) United States Patent
Prins

(10) Patent No.: US 6,198,806 B1
(45) Date of Patent: Mar. 6, 2001

(54) X-RAY EXAMINATION APPARATUS HAVING AN ADJUSTABLE X-RAY FILTER

(75) Inventor: Menno W. J. Prins, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/365,801

(22) Filed: Aug. 3, 1999

(30) Foreign Application Priority Data

Aug. 4, 1998 (EP) ..... 98202630

(51) Int. Cl.[7] ..... G21K 3/00
(52) U.S. Cl. ..... 378/159; 378/158
(58) Field of Search ..... 378/156–159

(56) References Cited

FOREIGN PATENT DOCUMENTS

WO9613040 5/1996 (WO) ..... G21K/3/00
WO9703449 1/1997 (WO) ..... G21K/3/00

*Primary Examiner*—Craig E. Church
(74) *Attorney, Agent, or Firm*—John F. Vodopia

(57) ABSTRACT

The invention relates to an X-ray examination apparatus which includes an X-ray filter for locally attenuating the X-ray beam. The X-ray filter includes a plurality of filter elements. The X-ray absorption of a filter element is adjusted by way of the quantity of X-ray absorbing liquid present in the filter element. The filling of the filter element is adjusted by means of an electric voltage. In addition to the X-ray absorbing liquid, the filter element contains a second liquid which is present at an interface between the X-ray absorbing liquid and the filter element, said second liquid being chemically inert relative to the X-ray absorbing liquid and having an electrical conductivity which deviates from that of the first liquid.

8 Claims, 3 Drawing Sheets

X-RAY EXAMINATION APPARATUS HAVING AN ADJUSTABLE X-RAY FILTER

Figure 1:
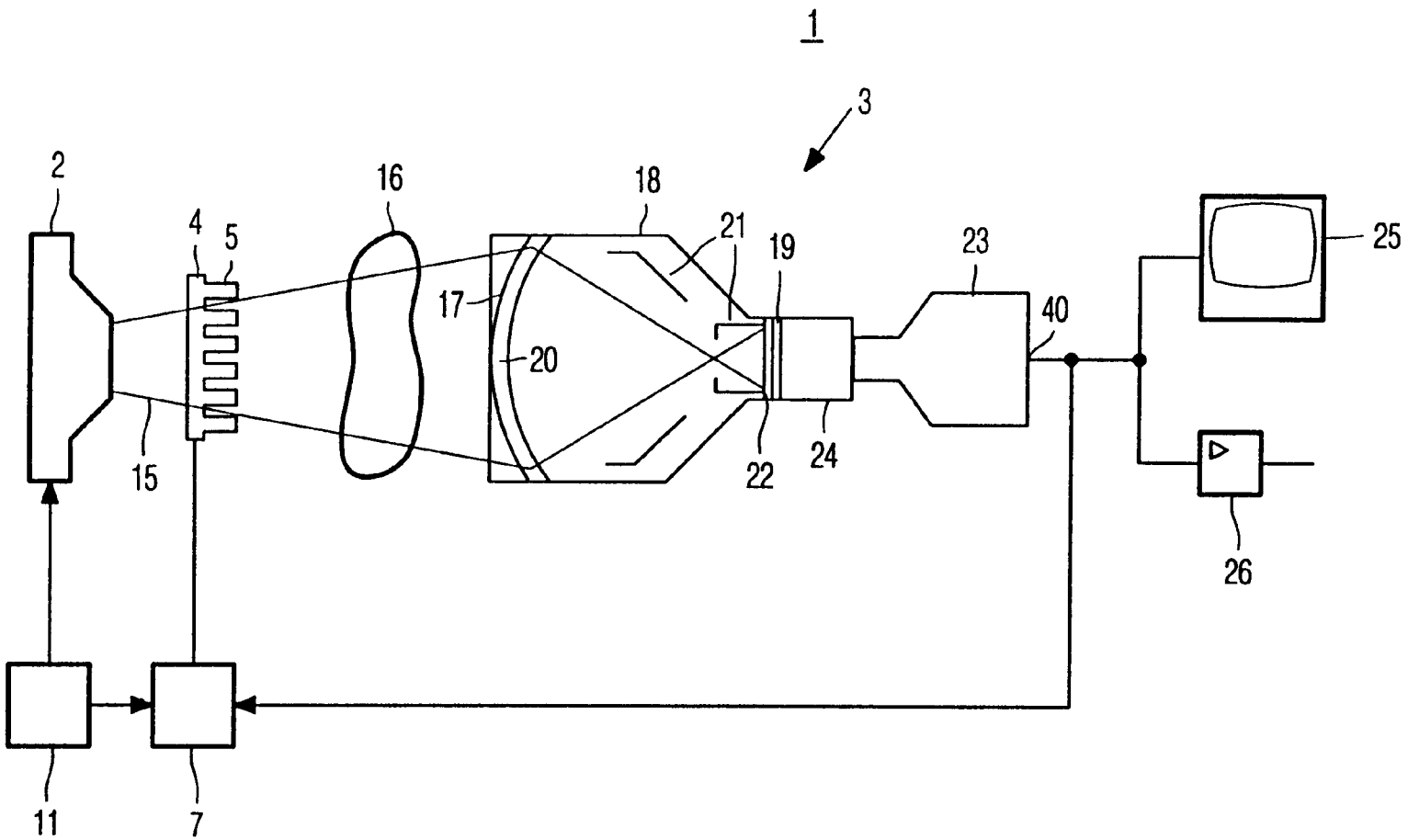

The invention relates to an X-ray examination apparatus for forming X-ray images of an object, including an X-ray source for generating an X-ray beam, an X-ray filter which is provided with filter elements, a wall of which is provided with an electrically conductive layer and an electrically insulating coating layer, the filter elements containing a first liquid, the quantity of which can be adjusted so as to adjust an intensity profile on the object, and an X-ray detector for detecting X-ray images.

The invention also relates to an X-ray filter for use in such an X-ray examination apparatus.

A device of the kind set forth is described in international patent application WO 96/13040. The X-ray filter in the known X-ray examination apparatus is used to limit the dynamic range of an X-ray image, formed on the X-ray detector, of an object, for example a human or animal body to be examined. The filter elements of the X-ray filter are constructed as capillary tubes, one end of which communicates with the first liquid. The X-ray absorptivity of the liquid can be increased by using aqueous solutions of salts of, for example lead, cesium or tungsten. The adhesion of the first liquid to the electrically insulating coating layer is adjustable by way of an electric voltage which is applied across the electrically conductive layer and the first liquid. The filling of each of the capillary tubes can thus be adjusted by variation of the electric voltage, so that the X-ray absorption profile of the X-ray filter is adjusted within a short period of time, for example 0.4 seconds. A voltage adhesion characteristic of a capillary tube of the X-ray filter represents a relationship between the electrically insulating coating layer and the first liquid in the capillary tube and the voltage applied across the electric conductor and the first liquid. It is a drawback of the known X-ray filter that the voltage adhesion characteristic is liable to change so that, for example the service life of the X-ray filter is reduced.

It is an object of the invention to provide an X-ray examination apparatus in which the changing of the voltage adhesion characteristic is counteracted. To this end, an X-ray examination apparatus according to the invention is characterized in that the filter elements contain a second liquid at an interface of the electrically insulating coating layer with the first liquid, the second liquid being inert relative to the first liquid and having an electrical conductivity which deviates from that of the first liquid. Attractive embodiments of the X-ray examination apparatus are defined in the dependent Claims. The invention is based on the recognition of the fact that a three-phase system is thus formed in which the electrically insulating coating layer, the first liquid and the second liquid maintain their respective phase and the first and the second liquid constitute a thermodynamically stable two-phase system. Furthermore, the chemical interaction with the electrically insulating coating layer and the first liquid is reduced. The chemical interaction occurs because in comparison with the remainder of the capillary tube, a high electric field strength arises near the interface, for example a contact line between the first liquid and the electrically insulating coating layer. This high field strength is due to the small radius of curvature along the contact line. Because of the high field strength, the electric field induces a chemical reaction at the interface so that atoms or ions of the first liquid are left behind in the coating layer. Because the second liquid is inert relative to the coating layer, the chemical reaction induced by the electric field is less than in the known X-ray examination apparatus, without using the second liquid, and the changing of the voltage adhesion characteristic is counteracted. An advantage of a reduced changing of the voltage adhesion characteristic consists in that the service life of the X-ray filter can be prolonged to, for example $10^5$ switching cycles. It is a further advantage of the presence of the second liquid that hysteresis in the voltage adhesion characteristic is reduced.

A special embodiment of the X-ray examination apparatus according to the invention is characterized in that the filter elements also contain a gas. When the filter elements are partly filled with, for example air, a lower flow resistance of the first liquid in the filter element is achieved, so that the response time of the X-ray filter is reduced.

A further embodiment of the X-ray examination apparatus according to the invention is characterized in that the first liquid contains a polar liquid with a solution of salts or that it contains a liquid metal. It is an advantage of polar liquids that salts are readily soluble therein, so that it is simply possible to adapt the electrical conductivity and to compose an X-ray spectrum so that the absorption spectrum of the first liquid can be adapted to the spectrum of the X-ray source or the spectrum of the X-ray detector. An example of a polar liquid is an aqueous solution of lead nitrate, $Pb(NO_3)_2$ or lead perchlorate, $Pb(ClO_4)_2$. It is an advantage of liquid metals that they have a high density, and hence a high X-ray absorptivity, in comparison with, for example aqueous solutions. The use of liquid metals is described in European patent application EP 98201706.3.

A further embodiment of the X-ray examination apparatus according to the invention is characterized in that the second liquid contains an apolar non-fluoridized hydrocarbon compound or a silicon oil. The miscibility of these liquids with polar liquids is low; they are chemically inert and have a low electrical conductivity in comparison with the first liquid. In the context of the present application electrically conductive is to be understood to mean a specific conductivity $\sigma$.

Another embodiment of the X-ray examination apparatus according to the invention is characterized in that the filter elements are filled exclusively with the first liquid and the second liquid, the X-ray absorptivity of the first liquid deviating from that of the second liquid. As a result of this step, the voltage adhesion characteristic of the filter elements is rendered less dependent on an orientation of the filter elements relative to the force of gravity, thus enabling the use of the X-ray filter in an X-ray examination apparatus comprising a C-arm.

A further embodiment of the X-ray examination apparatus according to the invention is characterized in that the second liquid also contains compounds containing iodine or bromium. Solution of compounds containing iodine or bromium yields filter elements whose electrical conductivity is lower relative to the first liquid whereas the X-ray absorptivity of the second liquid is higher than that of the first liquid. A second liquid having a lower electrical conductivity and a higher X-ray absorptivity offers the advantage that X-ray absorbing deposits from the second liquid onto the coating layer are counteracted, thus increasing the service life of the X-ray filter. An example of such a second liquid is hexadecane in which, for example $Ch_2I_2$ or 1,3,5-triiodine benzene is dissolved.

A further embodiment of the X-ray examination apparatus according to the invention is characterized in that the electrically insulating coating layer contains two sub-layers, a first sub-layer being provided on the electrically conductive layer whereas the second sub-layer is provided on the first sub-layer, the first sub-layer containing parylene, silicon oxide, silicon nitride or an anodic oxide whereas the second sub-layer contains a hydrophobic material. The use of an electrically insulating coating layer comprising two sub-layers is known from the international patent application WO 97/03449. A combination of this kind has suitable electrically insulating properties and ensures a large contact angle between the wall and the first liquid so as to enable the draining of the liquid from the filter element. An example of an anodic oxide is aluminium oxide, $Al_2O_3$, or tantalum oxide $Ta_2O_3$.

A further embodiment of the X-ray examination apparatus according to the invention is characterized in that the filter elements include a capillary tube. As a result, a small variation of the applied voltage will cause a large variation of the quantity of first liquid present in the capillary tube.

The invention also relates to an X-ray filter for use in an X-ray examination apparatus as defined in claim 1. The above and other, more detailed aspects of the invention will be described in detail hereinafter, by way of example, with reference to the drawing.

Figure 2:
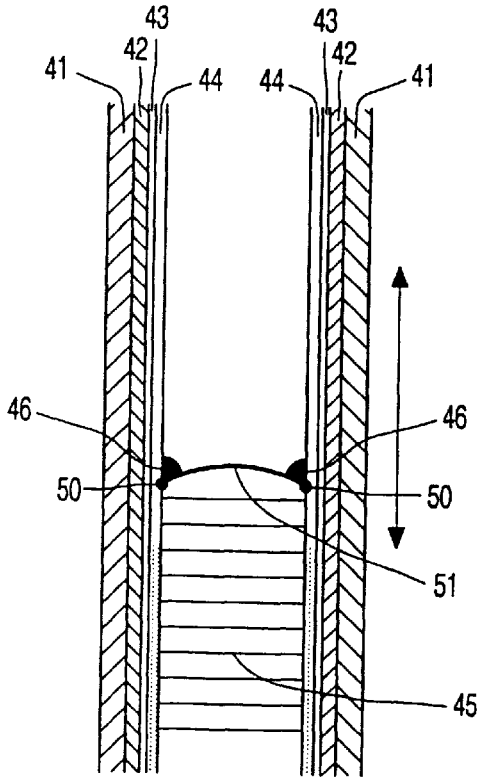
Figure 3:
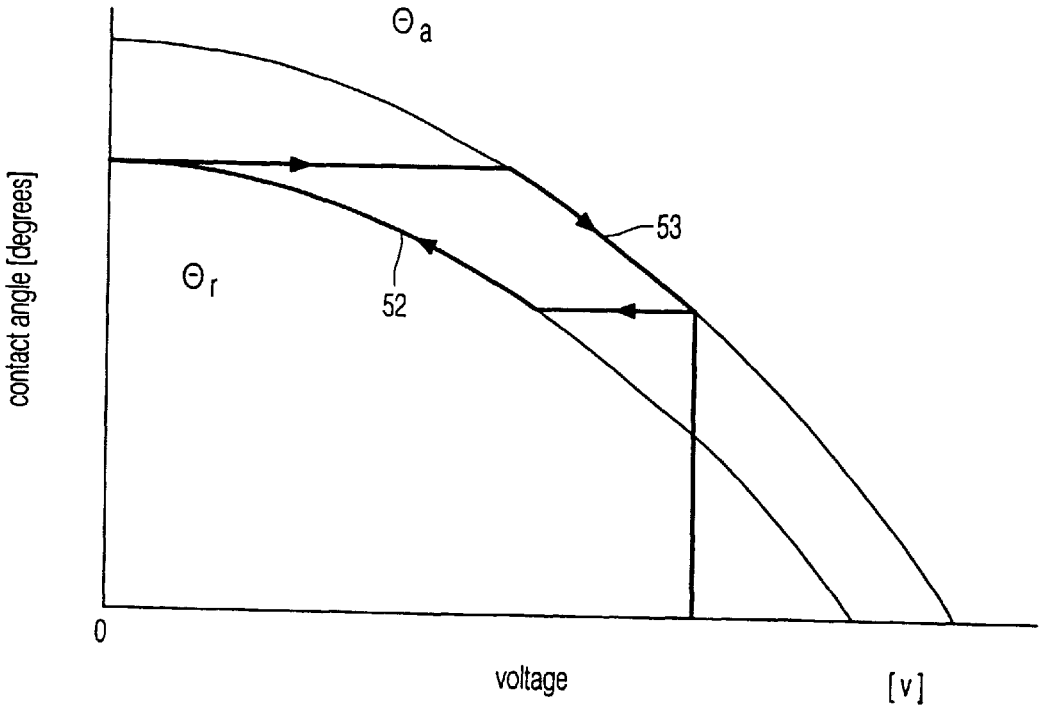
Figure 4:
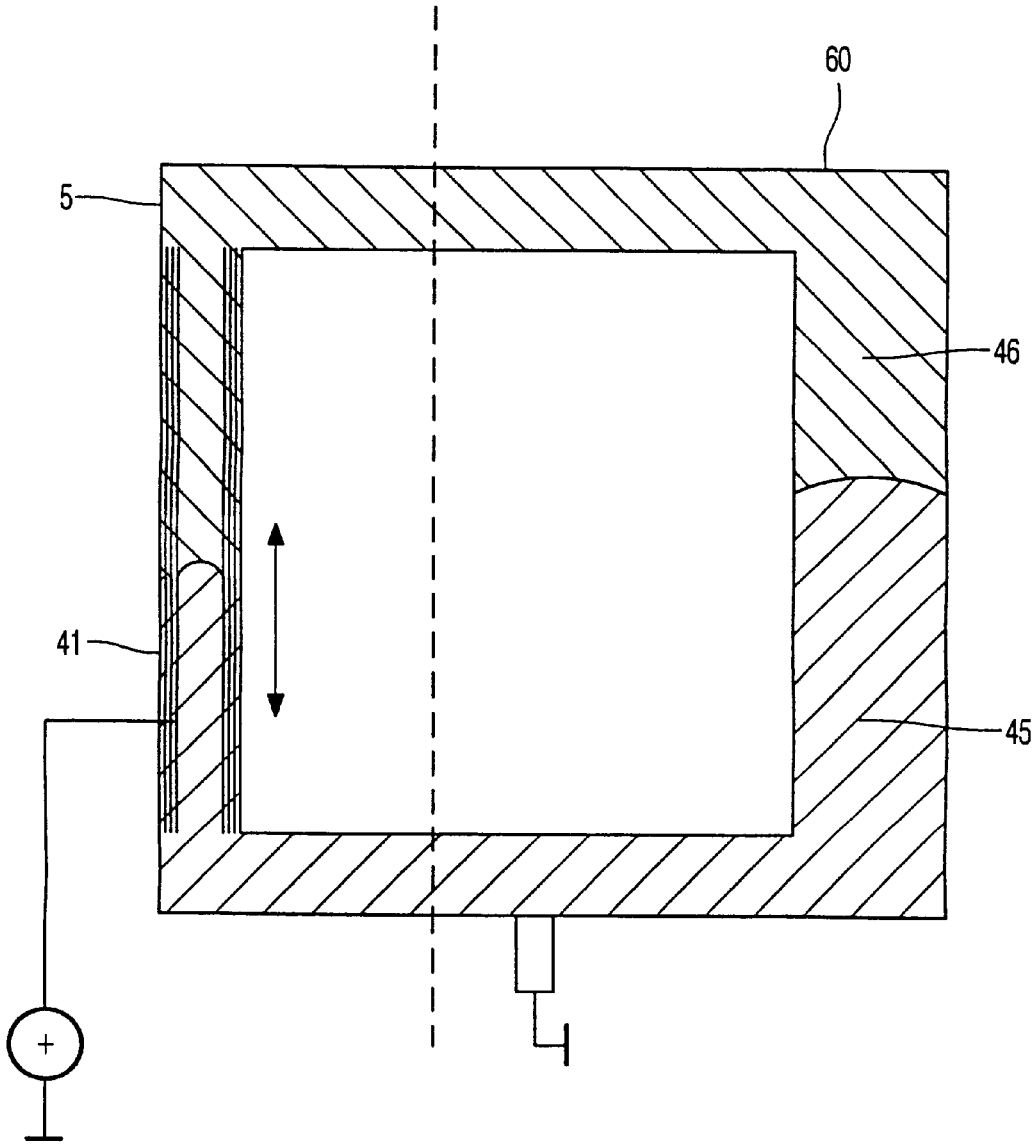

In the drawing:

FIG. 1. shows an X-ray examination apparatus,

FIG. 2 shows a first embodiment of an X-ray filter according to the invention, FIG. 3 shows an example of a voltage adhesion characteristic, and FIG. 4 shows a second embodiment of an X-ray filter according to the invention.

FIG. 1 shows an embodiment of an X-ray examination apparatus. The X-ray source 2 emits an X-ray beam 15 for irradiating an object 16. Due to differences in X-ray absorption within the object 16, for example a patient to be radiologically examined, an X-ray image is formed on an X-ray sensitive surface 17 of the X-ray detector 3 which is arranged opposite the X-ray source. The X-ray detector is provided, for example with an image intensifier/pick-up chain which includes an X-ray image intensifier 18 for converting an X-ray image into an optical image on an exit window 19, and a video camera 23 for picking up the optical image. An entrance screen 20 acts as the X-ray sensitive surface which converts incident X-rays into an electron beam which is imaged on the exit window 19 by means of an electron optical system 21. The incident electrons generate the optical image by means of a phosphor layer 22 on the exit window. The video camera 23 is optically coupled to the X-ray image intensifier 18 by means of an optical coupling. The optical coupling comprises, for example a system of lenses or an optical fiber coupling 24. The video camera derives an electronic image signal 40 from the optical image and applies the electronic image signal to a monitor 25 for visualizing the image information of the X-ray image. The electronic image signal can also be applied, for example to an image processing unit 26 for further processing. Between the X-ray source 2 and the object 16 there is arranged an X-ray filter 4 for locally attenuating the X-ray beam 15 in order to adjust a two-dimensional intensity profile. The X-ray filter includes a large number of filter elements 5. Furthermore, a filter element 5 preferably includes a capillary tube. The capillary tubes communicate, by way of a first opening, with a reservoir (not shown in FIG. 1) which contains a first liquid. The X-ray absorptivity is adjustable by application, preferably using an adjusting unit 7, of electric voltages across the inner side of the capillary tubes 5 and the first liquid. This is because the adhesion of the first liquid to the inner side of the capillary tubes is dependent on the electric voltage applied across the inner side of the capillary tubes and the first liquid. The capillary tubes are filled with a given quantity of the first liquid in dependence on the electric voltage across the individual capillary tubes 5 and the first liquid. Because the capillary tubes extend approximately parallel to the X-ray beam, the X-ray absorptivity of the individual capillary tubes is dependent on the relative quantity of first liquid present in such a capillary tube. The electric adjusting voltages of the individual filter elements are adjusted by means of the adjusting unit 7 while taking into account the brightness values in the X-ray image and/or the adjustment of the X-ray source 2. To this end, the adjusting unit 7 is coupled to an output terminal 10 of the video camera 23 and to the power supply 11 of the X-ray source 2. The first liquid contains, for example a polar liquid such as water. In order to increase the X-ray absorptivity, for example salts of lead, cesium or tungsten, for example $Pb(NO_3)_2$, CsCl or $W_4O_{13}$ can be dissolved therein. The construction of an X-ray filter of this kind is described in detail in the international patent application WO 96/13040.

In order to counteract a change of a voltage adhesion characteristic of the first liquid of the X-ray filter, a second liquid is added at an interface between the first liquid and the electrically insulating coating layer. This will be elucidated with reference to the FIGS. 2 and 3.

FIG. 2 shows a first embodiment of an X-ray examination device according to the invention. FIG. 2 shows an example of a capillary tube 5 of an X-ray filter 4. The wall 41 of the capillary tube contains a material consisting of elements having a low atomic number, for example a synthetic material. The wall 41 is covered with an electrically conductive layer 42, for example a copper, aluminium or tantalum layer having a thickness of, for example 20 nm. An advantage of the use of aluminium or tantalum resides in the fact that in the case of a suitable polarity, a self-restoring effect occurs upon electric breakdown of an overlying electrically insulating coating layer 43, so that the insulating layer is restored. The electrically insulating coating layer also comprises two sub-layers, i.e. a first electrically insulating sub-layer 43 and a second, porous sub-layer 44. Duplex layers of this kind are known from the previously mentioned International patent application WO 97/03449. Duplex layers of this kind offer suitable electrical insulation and a large contact angle between the first liquid and the wall of the capillary tube. The first electrically insulating sub-layer contains, for example parylene, silicon oxide, silicon nitride or an anodic oxide. In the case of parylene the layer has a thickness of between 1 and 10 $\mu$m, for example 5 $\mu$m. In the case of silicon oxide, silicon nitride or an anodic oxide, the layer has a thickness of between 30 and 500 nm, for example 100 nm. An anodic oxide is, for example aluminium oxide, $Al_2O_3$, or tantalum oxide, $Ta_2O_3$. The second sub-layer contains a hydrophobic material, for example an apolar fluoridized compound such as a perfluoropolymer, and has a thickness of, for example 100 nm. The capillary tube furthermore contains a first liquid, for example a polar liquid such as water or formamide with a solution of salts of, for example lead, cesium or tungsten, such as $Pb(NO_3)_2$, CsCl or $W_4O_{13}$ in a concentration of, for example 1 mole per liter. A liquid material can also be used as the first liquid. Metals of this kind contain, for example Hg, Ga, In or Pb. The use of alloys having a melting point below 100 degrees Celsius is also possible. The use of such liquid metals is described in the cited patent application EP 98201706.3. The capillary tube also contains a gas, for example air, nitrogen or a rare gas. The addition of a second liquid, being inert relative to the electrically insulating coating layer and the first liquid and having an electrical conductivity which deviates from that of the first liquid, counteracts the changing of the voltage adhesion characteristic. When the changing of the voltage adhesion characteristic is thus counteracted, the service life of the X-ray filter will be increased from the customary $10^3$ cycles for the known X-ray filters to approximately $10^5$ switching cycles. FIG. 3 shows an example of such a voltage adhesion characteristic.

FIG. 3 shows a voltage adhesion characteristic; the voltage across the capillary tube and the first liquid is plotted on a first axis and a contact angle of the meniscus of the first liquid and the electrically insulating coating layer is plotted on a second axis. The contact angle, and hence the capillary rise in the capillary tube, is related to the applied voltage and the thickness of the coating layer. A first line 53 of the voltage adhesion characteristic exhibits a relative change of the contact angle as a function of the applied voltage during the filling of the capillary tube. A second line 52 of the voltage adhesion characteristic shows a relative change of the contact angle as a function of the applied voltage during the draining of the capillary tube.

The addition of a second liquid at the interface of the first liquid and the electrically insulating coating layer of the capillary tubes can be realized by wetting the capillary tubes of the X-ray filter with the second liquid prior to assembly, so that the second liquid penetrates the porous second sub-layer. After the X-ray filter 4 has been filled with the first liquid 45, the second liquid is present at the interface between the electrically insulating coating layer and the first liquid. FIG. 2 shows the interface of the electrically insulating coating layer with the first liquid 45, said interface being formed by a contact line 50 along the meniscus 51 and the wall 41. The second liquid contains, for example an apolar non-fluoridized hydrocarbon, such as hexadecane or other alkenes, or a silicon oil. It is also possible to add a larger quantity of the second liquid, so that a small supply of second liquid 46 remains along the edge of the meniscus 51 of the first liquid 45 after completion of the X-ray filter and the electrically insulating coating layer thus remains wetted by the second liquid when the liquid level changes. FIG. 4 shows a second embodiment of the X-ray examination apparatus.

FIG. 4 is a sectional view of a capillary tube of the second embodiment of the X-ray filter. The inner side of the capillary tube is covered with an electrically conductive layer and an electrically insulating coating layer in the same way as the capillary tube described with reference to FIG. 2. Furthermore, both ends of the capillary tube are connected to a reservoir, for example a second duct 60 which is situated outside the X-ray beam to be generated. This second embodiment can be used, for example in an X-ray examination apparatus provided with a C-arm construction. In order to counteract the effects of the force of gravity when the capillary tube is not positioned parallel to the force of gravity, the capillary tube in the second embodiment of the X-ray examination apparatus according to the invention is completely filled with, for example the first and the second liquid. A part of the first or the second liquid is then displaced from and to the second tube 60 in dependence on a potential applied to the wall of the capillary tube 5 and the first liquid 45. Furthermore, the first liquid 45 has an electrical conductivity which is higher than that of the second liquid 46 and the two liquids also have a different X-ray absorptivity. This results in two practical versions. In a first version the X-ray absorptivity of the first liquid 45 is higher than that of the second liquid 46, and in a second version the X-ray absorptivity of the first liquid 45 is lower than that of the second liquid 46.

The first liquid 45 in the first version contains a polar liquid such as, for example water or formamide with a solution of salts of, for example lead, cesium or tungsten, such as $Pb(NO_3)_2$, CsCl or $W_4O_{13}$, in order to make the X-ray absorptivity of the first liquid higher than that of the second liquid. The concentration thereof amounts to, for example 1 mole per liter. The second liquid 46 of the first version contains a non-fluoridized hydrocarbon compound, for example, an alkene such as hexadecane.

The first liquid 45 in the second version contains a polar liquid, for example water with a salt solution in order to make its electrical conductivity higher than that of the second liquid 46; furthermore, the second liquid of the second version contains an apolar liquid or a silicon oil in which, for example $Ch_2I_2$, 1,3,5-triiodine benzene or $CHBr_3$ has been dissolved, for example with a concentration of 0.5 mole/liter, in order to make the X-ray absorptivity of the second liquid higher than that of the first liquid. An advantage of the second version resides in the fact that X-ray absorbing deposits from the second liquid onto the electrically insulating coating layer are counteracted, so that the service life of the X-ray filter is prolonged.

What is claimed is:

1. An X-ray examination apparatus for forming X-ray images of an object, including an X-ray source for generating an X-ray beam, an X-ray filter which is provided with filter elements, a wall of which is provided with an electrical conductor and an electrically insulating coating layer, the filter elements containing a first liquid, the quantity of which can be adjusted so as to adjust an intensity profile on the object, and an X-ray detector for detecting an X-ray image, characterized in that the filter elements contain a second liquid at an interface of the electrically insulating coating layer with the first liquid, the second liquid being inert relative to the first liquid and having an electrical conductivity which deviates from that of the first liquid.

2. An X-ray examination apparatus as claimed in claim 1, in which the filter elements also contain a gas.

3. An X-ray examination apparatus as claimed in claim 1, in which the first liquid contains a polar liquid with a solution of salts or contains a liquid metal.

4. An X-ray examination apparatus as claimed in claim 1, in which the second liquid contains an apolar non-fluoridized hydrocarbon compound or a silicon oil.

5. An X-ray examination apparatus as claimed in claim 1, in which the filter elements contain exclusively the first liquid and the second liquid, the X-ray absorptivity of the first liquid deviating from that of the second liquid.

6. An X-ray examination apparatus as claimed in claim 5, in which the second liquid also contains a compound containing iodine or bromium.

7. An X-ray examination apparatus as claimed in claim 1, in which the filter elements comprise a capillary tube.

8. An X-ray examination apparatus as claimed in claim 1, in which the electrically insulating coating layer contains two sub-layers, a first sub-layer being provided on the electrically conductive layer whereas the second sub-layer is provided on the first sub-layer, the first sub-layer containing parylene, silicon oxide, silicon nitride or an anodic oxide whereas the second sub-layer contains a hydrophobic material.

* * * * *